United States Patent [19]

Schiestl et al.

[11] Patent Number: 4,732,086

[45] Date of Patent: Mar. 22, 1988

[54] FIN STABILIZED ARMOR-PENETRATING TRACER PROJECTILE AND METHOD OF MANUFACTURING SAME

[75] Inventors: Randall L. Schiestl, Brooklyn Park; Paul D. Ruffle, Edina, both of Minn.

[73] Assignee: Honeywell Inc., Minneapolis, Minn.

[21] Appl. No.: 6,859

[22] Filed: Jan. 27, 1987

[51] Int. Cl.[4] ..... F42B 11/16

[52] U.S. Cl. ..... 102/513; 102/517; 102/521; 244/3.24; 244/3.3

[58] Field of Search ..... 102/501, 517–519, 102/520, 521; 244/324, 3.3; 29/1.2–1.23

[56] References Cited

U.S. PATENT DOCUMENTS 4,015,534 4/1977 Engel et al. ..... 102/513
4,536,928 8/1985 Nicklas et al. ..... 29/1.2

FOREIGN PATENT DOCUMENTS 2123124 1/1984 United Kingdom ..... 102/513

*Primary Examiner*—Harold J. Tudor

*Attorney, Agent, or Firm*—Edward W. Hughes; Roger W. Jensen

[57] ABSTRACT

A method of securing a tracer cup 26 and fin segments 32, 33 to armor piercing penetrator 21. The penetrator 21 is fabricated of tungsten, or steel, with fin segments 32, 33 and tracer cup 26 being fabricated of steel. The tracer cup 26 contains a pyrotechnic tracer mix 27. The mounting flange 28 of tracer cup 26 is placed over a second boss 24 projecting rearwardly from a first boss 23 at the aft end of the cylindrical body of penetrator 21. A cylindrical sleeve 30 is press fit over the tracer cup 26 and first boss 23, and pre-fabricated fin segments 32, 33 are positioned on the sleeve 30. The fin segments 32, 33, cylindrical sleeve 30, and mounting flange 28 of tracer cup 26 are laser welded to each other and to the first boss 23 of penetrator 20 in one step. Increased laser power is applied to weld a fin segment 32 or 33 to the sleeve 30 and the sleeve 30 to the first boss 23 of the penetrator 20 and the sleeve 30 to the mounting flange 28 of tracer cup 26 compared with the magnitude of the laser power applied to weld a fin vane assembly 32 or 33 to the sleeve 30.

4 Claims, 4 Drawing Figures

FIN STABILIZED ARMOR-PENETRATING TRACER PROJECTILE AND METHOD OF MANUFACTURING SAME

The Government has rights to this invention pursuant to Contract No. DAAK10-82-C-0296 awarded by the Department of the Army.

BACKGROUND OF THE INVENTION

1. Field of the Invention

This invention is in the field of Armor Penetrating, Fin Stabilized, Discarding Sabot, Tracer (APFSDS-T) projectiles and the method of manufacturing same. In particular, it relates an improved fin-tracer-penetrator ammunition and to the method of manufacturing said projectile.

2. Description of the Prior Art

A conventional armor piercing penetrator has a cylindrical body having a pointed leading end for reduced aerodynamic drag and a trailing end on which a tracer cup and stabilizing fins are mounted. The mounting portion for the tracer cup and stabilizing fins consists of a first boss which projects rearwardly from the trailing end, and a second boss which projects rearwardly from the first boss. Typically, a tracer cup containing a pyrotechnic tracer mix is fitted over the second boss, and then mechanically crimped to the second boss. Next, a sleeve is pressed over the tracer cup and the first boss. Formed fins are then positioned on the tube and the fins and sleeve are welded to the first boss of the penetrator. Such a method of assembly is relatively time consuming and inefficient. In addition, tracer cups secured to penetrators using the prior art process have separated from the penetrators on which they are mounted during launch.

SUMMARY OF THE INVENTION

The present invention provides an improved method of securing the formed steel fins, a steel cylindrical fastening sleeve, and a steel tracer cup to each other and to a tungsten or steel penetrator in a single fastening operation, or step. The components of the fin tracer penetrator assembly, are laser welded to one another with increased laser power being used when the laser beam welds the formed fins to the fastening sleeve, the fastening sleeve to the penetrator, and the fastening sleeve to the mounting flange of the tracer cup. Reduced power is used in welding the formed fins to the fastening sleeve. The method is low in cost and the resulting penetrator assemblies are structurally more sound than those of prior art APFSDS-T projectiles because the possibility of a tracer cup separating from its penetrator during launch is essentially nil.

BRIEF DESCRIPTION OF THE DRAWINGS

The invention will be better understood from the following description when read in conjunction with the following drawings, wherein.

DETAILED DESCRIPTION OF THE DRAWINGS

Figure 1:
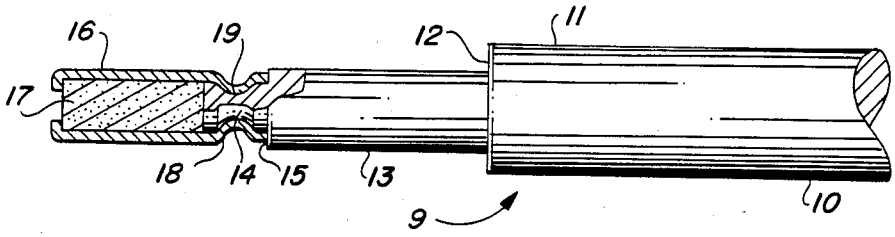
FIG. 1 (PRIOR ART)
FIG. 1 is a fragmentary side elevational view partially in section of a prior art penetrator and tracer cup projectile.

FIG. 1 illustrates the prior art method of securing a tracer cup to a penetrator of an APFSDS-T type projectile. Projectile 9 comprises a penetrator 10 having a cylindrical after body 11 and a trailing edge, or end, 12. A first cylindrical boss 13 projects rearwardly from the trailing end 12. A second boss 14 projects rearwardly from land 15 which defines the end of the first boss 13. A cylindrical metal tracer cup 16 which is filled with a pyrotechnic tracer mix 17 is provided with an annular mounting flange 18 which is placed over second boss 14. Flange 18 is then mechanically crimped into the circumferential groove 19 of boss 14 so that tracer cup 16 is fastened to penetrator 10. Next, a sleeve, which is not illustrated, having a slight interference fit is pressed over tracer cup 16 and first cylindrical boss 13 with the forward edges of the sleeve meeting the trailing edge 12 of penetrator 10. Formed fins, which are also not illustrated, are then positioned over the sleeve and then that portion of the fins and sleeve overlying boss 13 of penetrator 10 are welded to each other and to boss 13.

Figure 2:
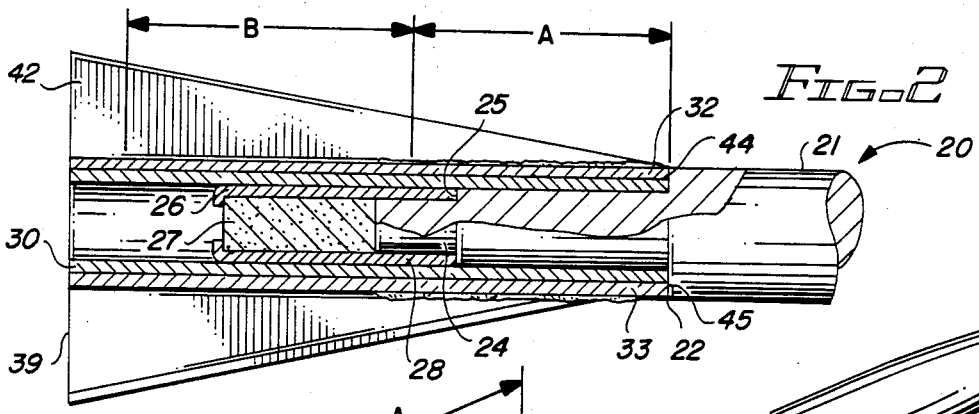
FIG. 2 is a fragmentary side elevational view, partially in section of a penetrator assembly according to the present invention, with portions thereof broken away to show relevant features.
Figure 3:
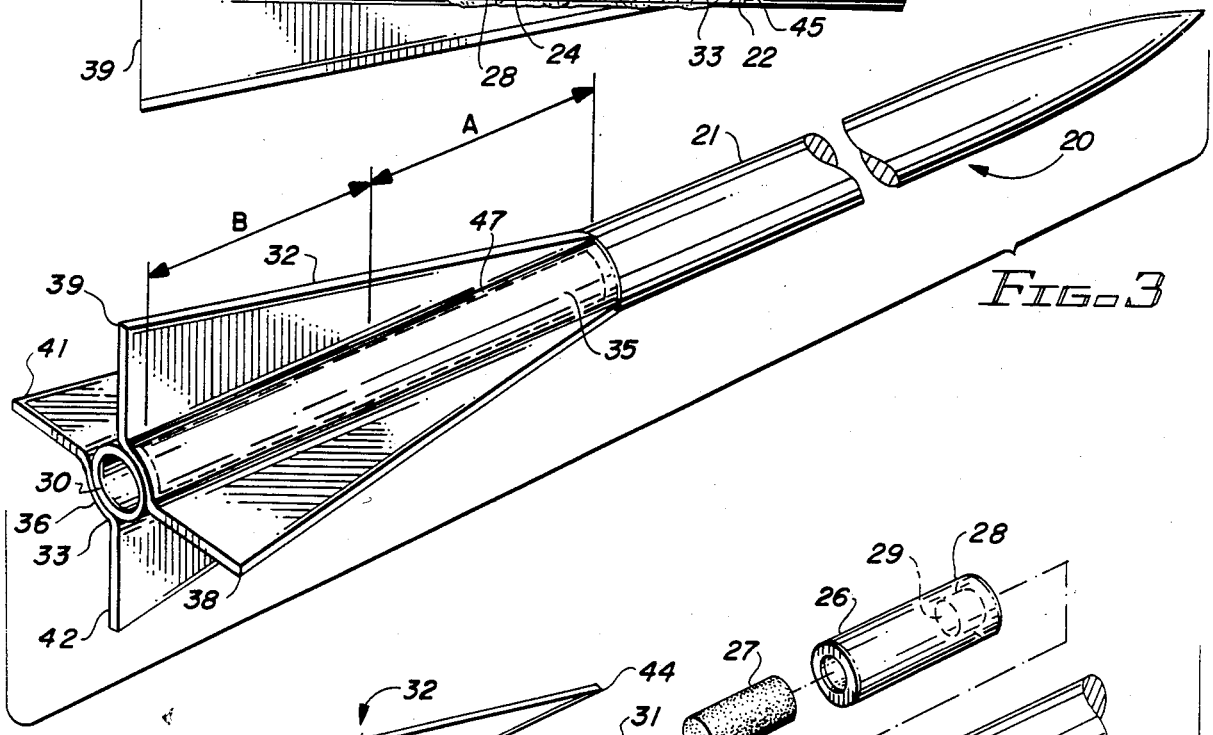
FIG. 3 is a perspective view of the projectile of this invention showing the location of the welds securing a fin segment, a fastening sleeve, and a tracer cup to the penetrator.
Figure 4:
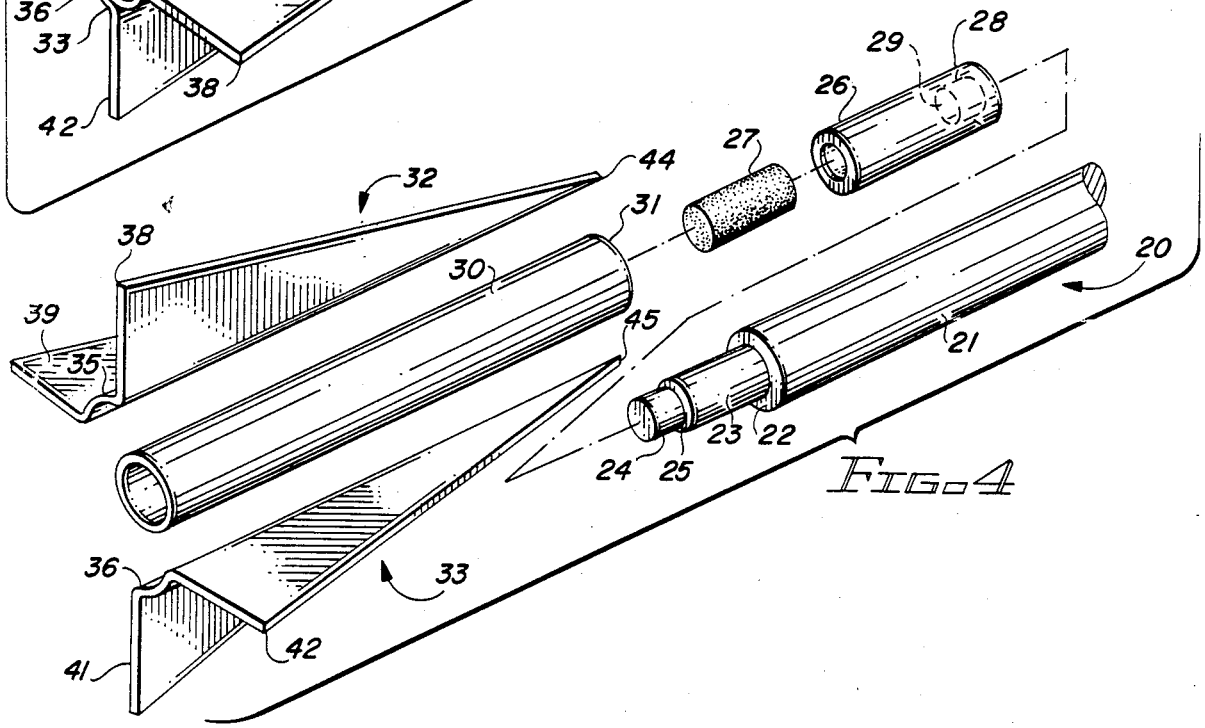
FIG. 4 is a perspective view showing the parts of the penetrator assembly in exploded relation with the fin segments rotated ninety degress.

FIGS. 2, 3 and 4 show the improved assembly of the present invention. The basic design of projectile 20 remains unchanged. Penetrator 21 of Projectile 20 has a cylindrical after body, a trailing edge, or end, 22, a first cylindrical boss 23, a second boss 24, and, a land 25, all of which are structurally and functionally similar to that of their counterparts in conventional projectile 9. Penetrator 21 is preferably made of tungsten or steel. Steel tracer cup 26 is filled with a pyrotechnic tracer mix, or grain, 27 and the forward portion of the cup 26 constitutes an annular mounting flange 28 which defines blind bore 29. Tracer cup 26 is positioned on second boss 24 with second boss 24 located within blind bore 29. The outer cylindrical surface of tracer cup 26 is substantially flush with, or has substantially the same outer diameter as, that of first boss 23.

Tracer cup 26 is retained in place on the second boss by cylindrical sleeve 30. The inner diameter of sleeve 30 is slightly less than the outer diameters of both tracer cup 26 and first boss 23 in order to effect a press fit between sleeve 30 tracer cup 26, and boss 23. Sleeve 30 is forced over tracer cup 26 and first boss 23 until its forward edge 31 contacts trailing end 22 of penetrator 21.

Formed fin segments 32, 33 each of which has an arcuate web 35, 36 integral with a pair of fins 38, 39 or 41, 42. In the preferred embodiment formed fin segments 32, 33 are stamped from sheet steel in a single step operation. Fins 38, 39, project radially outwardly from arcuate web 35, and fins 41, 42 have the same relationship with arcuate web 36. The radii of curvature of webs 35, 36 are such that the inner surfaces of webs 35, 36 of segments 32, 33, have substantially the same radius of curvature as the outer surface of cylindrical sleeve 30.

After tracer cup 26 is positioned on boss 24, sleeve 30 is press fit over tracer cup 26 and second boss 24 to position tracer cup 26 on second boss 24. Formed fin segments 32, 33 are then positioned on sleeve 30 with the leading edges 44, 45 of segments 32, 33 contacting the trailing edge 22 of penetrator 21, and with fins 38, 39, 41, and 42 being spaced substantially equiangularly around the circumference of sleeve 30.

When all the components have been assembled as described and illustrated, fin segments 32, 33, sleeve 30, and mounting flange 28 of tracer cup 26 are fastened, or secured, to one another and to boss 23 of penetrator 21 using laser welding techniques. In the preferred embodiment the welding step is performed using a commercially available "Laserdyne 780" laser welding machine. Welds are produced using a series of pulses of a laser beam. The energy of the laser beam, its pulse width, repetition rate and traverse speed are computer controlled to form a substantially rectangular continuous linear weld 47 as is best seen in FIG. 3. Laser welding a formed fin segment, such as fin segment 32 to sleeve 30 and sleeve 30 to boss 23 and sleeve 30 to tracer mounting flange 28 of tracer cup 26 is accomplished at one set of appropriate values for the power level; pulse rate, pulse width and feed rate, and welding web 35 of segment 32, to sleeve 30 is accomplished using an appropriately lower set of values. In making welds in a preferred embodiment, the values for the average power level is 625 watts, at a pulse rate of 100 pulses per second, with each pulse having a pulse width of 4 MS, and a feed rate of twenty inches per minute in zone A. In zone B, the values are at a power level of 450 watts at 100 pulse per second, with each pulse having a 4 MS pulse width, and a feed rate of 60 inches per minute. The use of laser welding to secure the components of projectile 20 is essential because other types of welding do not afford the required precise degree of heat and weld penetration control which is necessary in the potentially dangerous operation of welding devices containing a pyrotechnic material. With laser welding, an operator is able to maintain desired levels of laser power when welding web 35 of fin assembly 32 to sleeve 30 and sleeve 30 to boss 23 of penetrator 21 and sleeve 30 to mounting flange 28 of tracer cup 26 and to decrease the power of the laser beam when welding web 35 to sleeve 30. Thus the prior art method which requires a first securing step of mechanically crimping a tracer cup to the penetrator, and a second securing step of securing a fin assembly to the penetrator is superceded by Applicants' novel single securing step.

By welding the fin segments, sleeve and tracer cup to the penetrator in a single welding operation, an armor penetrating, fin stabilized penetrator with tracer projectile is produced which is structurally more sound since the stresses resulting from laser welding are considerably less than the stresses caused by mechanically crimping a tracer cup to a penetrator. In addition, tracer cup separation from the penetrator onto which it is welded after the penetrator is fired is essentially eliminated by this method of securing a tracer cup, a sleeve, and fin segments to a penetrator.

While the principles of the invention have now been made clear in the illustrated embodiment, it will be immediately obvious to those skilled in the art, that many modifications of structure, arrangements, proportions, elements, materials, and components used in the practice of the invention, and otherwise, which are particularly adapted for a specific environment and operation requirements, without departing from those principles. The appended claims are therefore intended to cover and embrace any such modifications within the limits only of the true spirit and scope of the invention.

We claim as our invention:

1. An armor-penetrating projectile 20 comprising:

a penetrator 21 including a cylindrical body having a trailing edge 22, a first cylindrical boss 23 projecting rearwardly from said trailing edge 22, and a second cylindrical boss 24 projecting rearwardly from said first boss 23;

a cylindrical tracer cup 26 containing a pyrotechnic tracer mix 27, said tracer cup 26 having an annular mounting flange 28 defining a blind bore 29 fitting on said second boss 24 of said penetrator 20;

a sleeve 30 fitting over said first boss 23 and said tracer cup 26 to position the tracer cup 26 on the second boss 24 and within sleeve 30; and a pair of fin segments 32, 33, each fin segment having a pair of fins 38, 39, 41, 42 projecting radially outwardly from an interconnecting arcuate web 35, 36, the webs 35, 36 of said fin segments 32, 33 being welded to the sleeve 30, and only the first boss of penetrator 21 being welded to the sleeve 30, and only the mounting flange 28 of the tracer cup 26 being welded to the sleeve 30.

2. The armor-penetrating projectile of claim 1, in which the fins 38, 39, 41, 42 are substantially uniformly positioned around the sleeve 30.

3. The armor-penetrating projectile 20 of claim 2, in which said penetrator 21, said fin segments 32, 33 and said tracer cup 26 are formed from steel.

4. The armor-penetrating ammunition projectile 20 of claim 3, in which said fin assemblies 32, 33 are formed from steel and said penetrator 21 is formed from tungsten.

* * * * *